US010646395B2

(12) United States Patent
Orndorff

(10) Patent No.: US 10,646,395 B2
(45) Date of Patent: May 12, 2020

(54) MULTIPLE TERRAIN MOBILITY DEVICE

(71) Applicant: Joshua Orndorff, Sterling, VA (US)

(72) Inventor: Joshua Orndorff, Sterling, VA (US)

( * ) Notice: Subject to any disclaimer, the term of this patent is extended or adjusted under 35 U.S.C. 154(b) by 0 days.

(21) Appl. No.: 15/653,684

(22) Filed: Jul. 19, 2017

(65) Prior Publication Data

US 2018/0021200 A1 Jan. 25, 2018

Related U.S. Application Data

(60) Provisional application No. 62/364,289, filed on Jul. 19, 2016.

(51) Int. Cl.
*A61H 3/00* (2006.01)

(52) U.S. Cl.
CPC ..... *A61H 3/00* (2013.01); *A61H 2003/001* (2013.01); *A61H 2201/0192* (2013.01)

(58) Field of Classification Search
CPC .... A61H 3/00; A61H 3/02; A61H 2201/0192; A61H 3/008; A61H 2003/001; A61H 2003/025; A61H 2201/0161; A61H 3/04; A45B 2009/007; A61G 5/08; A61G 5/0816
USPC ..... 135/66–69, 74, 75; 482/52, 66–67, 482/75–76
See application file for complete search history.

(56) References Cited

U.S. PATENT DOCUMENTS 1,917,440 A * 7/1933 Finkbeiner ..... A61H 3/00 135/67
2,634,790 A 4/1953 Elle
2,667,914 A 2/1954 Forbes
2,708,473 A * 5/1955 Gable ..... A61H 3/00 135/67
2,732,004 A * 1/1956 Forbes ..... A61H 3/04 482/67
3,176,700 A 4/1965 Drury, Jr.
3,387,617 A 6/1968 Reiber
3,387,618 A * 6/1968 Swann ..... A61H 3/02 135/67
3,421,529 A 1/1969 Vestal
3,455,313 A 7/1969 King
4,094,331 A * 6/1978 Rozsa ..... A61H 3/00 135/67
4,411,283 A 10/1983 Lucarelli
4,777,973 A 10/1988 Nakajima
4,993,446 A * 2/1991 Yarbrough ..... A61H 3/00 135/67
5,275,187 A * 1/1994 Davis ..... A61H 3/00 135/67

(Continued)

*Primary Examiner* — Winnie Yip
(74) *Attorney, Agent, or Firm* — Jonathan Brown

(57) ABSTRACT

A multiple terrain mobility device capable of use as a walker or crutches. The mobility device has a central cross support and a pair of crutch assemblies. Each respective crutch assembly has a rear support leg that can be extended downward or retracted upward and a front leg assembly that is capable of extending forward or retracting rearward. These adjustable extension features allow the mobility device, to traverse terrain of varying height such as stairs or hills with greater stability. The central cross support can be separated into a left and right cross support member so that the walker can be converted into a pair of crutches when conditions warrant.

18 Claims, 9 Drawing Sheets

(56) References Cited

U.S. PATENT DOCUMENTS

| | | | | |
|---|---|---|---|---|
| 5,349,977 | A * | 9/1994 | Wood | A61H 3/00 135/67 |
| 5,649,558 | A | 7/1997 | Richard | |
| 5,740,825 | A | 4/1998 | Brunengo | |
| 6,099,002 | A * | 8/2000 | Uchiyama | A61H 3/04 135/67 |
| 6,145,524 | A | 11/2000 | Li | |
| 6,453,921 | B1 | 9/2002 | Rost | |
| 6,733,018 | B2 * | 5/2004 | Razon | A61H 3/008 135/67 |
| 7,677,259 | B1 * | 3/2010 | Arbuckle | A61H 3/04 135/66 |
| 8,667,976 | B2 | 3/2014 | Huang | |
| 8,820,338 | B1 | 9/2014 | Catricala | |
| 9,119,757 | B2 | 9/2015 | Triolo | |
| 9,545,354 | B1 | 1/2017 | Klausmeyer | |
| 9,707,149 | B1 * | 7/2017 | Juarez | A43B 5/0419 |
| 2004/0020525 | A1 * | 2/2004 | Lev | A61H 3/04 135/66 |
| 2010/0258152 | A1 | 10/2010 | Lin et al. | |
| 2012/0298160 | A1 | 11/2012 | Hamilton | |
| 2013/0319488 | A1 | 12/2013 | Chiu | |
| 2016/0287464 | A1 | 10/2016 | Younger | |

* cited by examiner

MULTIPLE TERRAIN MOBILITY DEVICE

CROSS REFERENCE TO RELATED APPLICATION(S)

This application claims the benefit of U.S. Provisional Application No. 62/364,289 entitled "Walker Crutch Combination," filed on Jul. 19, 2016 the subject matter of which is hereby incorporated herein by reference in their entirety.

TECHNICAL FIELD OF THE INVENTION

The present invention relates to the general art of mobility devices and more specifically to mobility devices for traversing multiple types of changing terrain.

BACKGROUND OF THE INVENTION

Mobility aids such as walkers, crutches, and wheelchairs, are well known. When one m has a temporary injury or more permanent infirmity, these devices are often helpful, or even indispensable, for millions of people who need assistance at moving around. Walkers provide an extra four points of support for a user through a pair of hand grips, greatly increasing stability while moving around. If one leg is injured, such as a broken bone or torn tendon, a pair of crutches can provide an extra pair of supports, through handles and underarm pads, so a user can move around without using the affected leg.

However, such devices suffer from serious limitations. To move, crutches because they have only two points of stability, typically require a stable, reasonably level surface with a good amount of friction to function. To use them, a user must typically make a repeated movement wherein the tips of the crutches are typically repeatedly raised and lowered in a forward movement. If a user is on a low friction surface, such as an icy sidewalk, or an uneven surface, such as a wooded path, the crutches may slip from under the user, or become unstable on an uneven surface, each time the crutches are moved. Each time the crutches are moved is an opportunity for an accident.

Crutches can become particularly perilous when having to traverse an uneven surface, such as a set of stairs. While moving up a set of stairs on crutches can be difficult, moving downward can be even more dangerous. Since there is no point of stability in front of the crutches, a user can easily lose balance and fall.

While walkers offer more stability than crutches, as they typically have four stability points rather than two, they have several limitations as well. Walkers, because of their more limited motion, can be much slower than crutches. Some people are reluctant to use walkers, particularly in a professional setting, because they may make them look weaker or more debilitated than they actually are. Further, walkers can be somewhat bulky when not needed, even the folding kind.

One solution, in theory, would be to take both types of mobility aids when going out, so that one could use crutches for faster movement and aesthetics over terrain amenable to faster movement, but then a walker for tougher, slicker, or more uneven terrain. However, this would require a user, who already has at least one mobility issue, to carry around multiple devices, somewhat defeating the purpose of mobility aids.

What is needed is single, easily portable mobility aid that addresses these issues by providing a way to effectively and quickly traverse multiple types of terrain.

SUMMARY

A multiple terrain mobility device is disclosed. The mobility device provides the capability to transform and interchange between a Walker type device, and a pair of crutches, and additionally is capable, particularly in walker form, of traversing stairs and other types of difficult terrain.

The mobility device is comprised, generally, of a central cross support and a pair of generally rectangular crutch assemblies.

Each of the respective crutch assemblies is comprised of at least one vertically oriented front support leg and at least one vertically oriented rear support leg, each rear support leg being rearward relative to the position of a user of the mobility device facing forward. Each of the support bars can be, as in this embodiment, comprised of a single bar for greater strength, or can be a set of two bars fitted together at a junction at the respective central crutch handles.

The front and rear support legs are secured, and help secure, several horizontally oriented components. At the top, there are respective top hand grips that extend from the front support legs to the rear support legs and can be secured to them by means known in the art.

The mobility device can further comprise an upper support located just below the hand grips, and extending from the front to rear support legs to provide extra rigidity to the top area of each crutch assembly. A pair of respective center crutch handles are also located between the respective sets of support bars and are connected to the front support legs in a relative position beneath the cross support.

The center crutch allows a user, as with typical crutch handles, to grip the crutches as the top hand grips rest in the user's armpits. In the walker position, the user is gripping the top hand grips, while the center crutch handles, at this point, simply provide extra structural support. The crutch handles are elevation adjustable to accommodate individual users through any means known and commonly used in the art.

Similar to the upper supports, a set of lower supports can be placed at or near the bottom of the support bars to provide extra rigidity and support to the mobility device A basic rectangular structure is completed for each of the crutch assemblies by a respective lower support bar that connects the respective support bar sets to each other at the bottom of the structures. The lower support bars are secured to the respective support bars with suitable fittings capable of securing the lower support bars to the respective support bars, and respective extending or extendable lower legs.

The bottom support bars may be a single piece that fits within, and goes through, the front leg fitting, or the bottom support bar can be in two pieces, with one portion of the front leg fitting accommodating the portion of the bottom support bar between the front leg fitting and rear leg fitting(s) and another portion accommodating the portion of the lower support bar between the front leg fitting and the front extension fitting. In another embodiment, the front leg configuration may substitute use of the extension fittings with a front leg that is a single 90-degree piece with one end extending from (and still retractable into) the bottom support bar to the ground.

The front leg fitting is typically T-shaped and can accommodate the lower support bar and front support leg. The rear leg fitting is likewise typically T-shaped but with a different orientation, accommodating the rear support leg, lower support bar, and telescopic rear leg.

The rear leg extends downward from the rear leg fitting(s), and is capable of being retracted or extended to adjust the height of the leg. The rear leg may be solid or of a telescoping construction. The rear leg can be raised and lowered through adjustment apparatus. The front legs, like the rear legs, extend downward and both sets of legs have feet at the bottom of the legs for gripping the ground without causing damage.

The front legs are secured to the lower support bar with a 90-degree front extension fitting or the front legs can, as mentioned, be a single 90-degree piece.

The front of the bottom support bar, or the separate portion of the bottom support bar between the front leg fitting and front extension fitting, is extendable. The extension/retraction of the front legs can be accomplished via extension of the bottom support bar. This portion of the bottom support bar may be telescopic or of slightly smaller or larger diameter than the remainder of the bottom support bar so that it can collapse or retract within the remainder of the support bar. The front legs can, through this apparatus, be extended outward in a relatively forward direction to increase the stability of the mobility device. This can be particularly useful in uneven surfaces such as natural terrain or stairs. In this figure, the front legs, are extended in a forward position to provide the extra stability to the walker.

The crutch assembly portions are joined by a sturdy cross support capable of securing both assemblies, yet allowing the left and right cross support components to be swivelable. The cross support structure can, as in this embodiment, be generally curved to provide a concave space, thereby providing extra room for a user's hands to maneuver and use the crutch arms when in the crutch configuration. The respective crutch assembly portions are secured to the front support leg(s) by cross support moveable support apparatus which can be comprised of any means suitable in the art. The cross support is comprised of material and construction suitable to provide rigidity and support to the user and can be comprised of at least a pair of horizontal bars connected to the cross support moveable securing apparatus.

If a user needs to move upward, for example, up a set of stairs, the lower legs can be adjusted accordingly.

The rear legs can be extended further downward, to a point where the bottom of the leg is a suitable vertical distance below the bottom of the front leg. This can be done manually or with an extension controller. If a user needs to move downward, such as down a set of stairs, the rear leg can be retracted such that the bottom of the front leg is vertically lower than the bottom of the rear legs. With the level changed, the user can now safely move downward. The front legs can be extended back into a forward relative position by activation of the front leg extension apparatus with accompanying extension of the bottom support bars, If a user wants to make greater speed across a surface, the user can quickly and easily transform the mobility device from a walker configuration to a pair of crutch assembly configurations. If the terrain becomes less suited to crutches, the user can simply transform the crutch assemblies back to a walker configuration.

The cross support is further comprised of a left cross support piece and a right cross support piece. A separation apparatus is located at the junction between the Left and right cross support pieces that holds the respective support pieces together. When a user wants to convert the mobility device into crutches, the user activates the separation apparatus, thereby separating the cross support pieces. Once the cross support pieces are separated from each other, they can be swiveled with the cross support moveable securing apparatus to a position parallel to the hand grips. The front leg of each crutch can be swiveled 180 degrees to an upward orientation.

To convert the crutches back into a walker configuration, all the same steps are simply completed in reverse.

Accordingly, a multiple terrain mobility device and method of use that provides the capability of moving across multiple types of terrain and traversing obstacles such as stairs, is provided.

DETAILED DESCRIPTION OF PREFERRED EMBODIMENTS

Other objects, features and advantages of the invention will become apparent from a consideration of the following detailed description and the accompanying drawings. The following descriptions are made referring to the figures, wherein like reference numbers refer to like features throughout this description. Not all numbers appearing in one figure are necessarily present in another.

Figure 1:
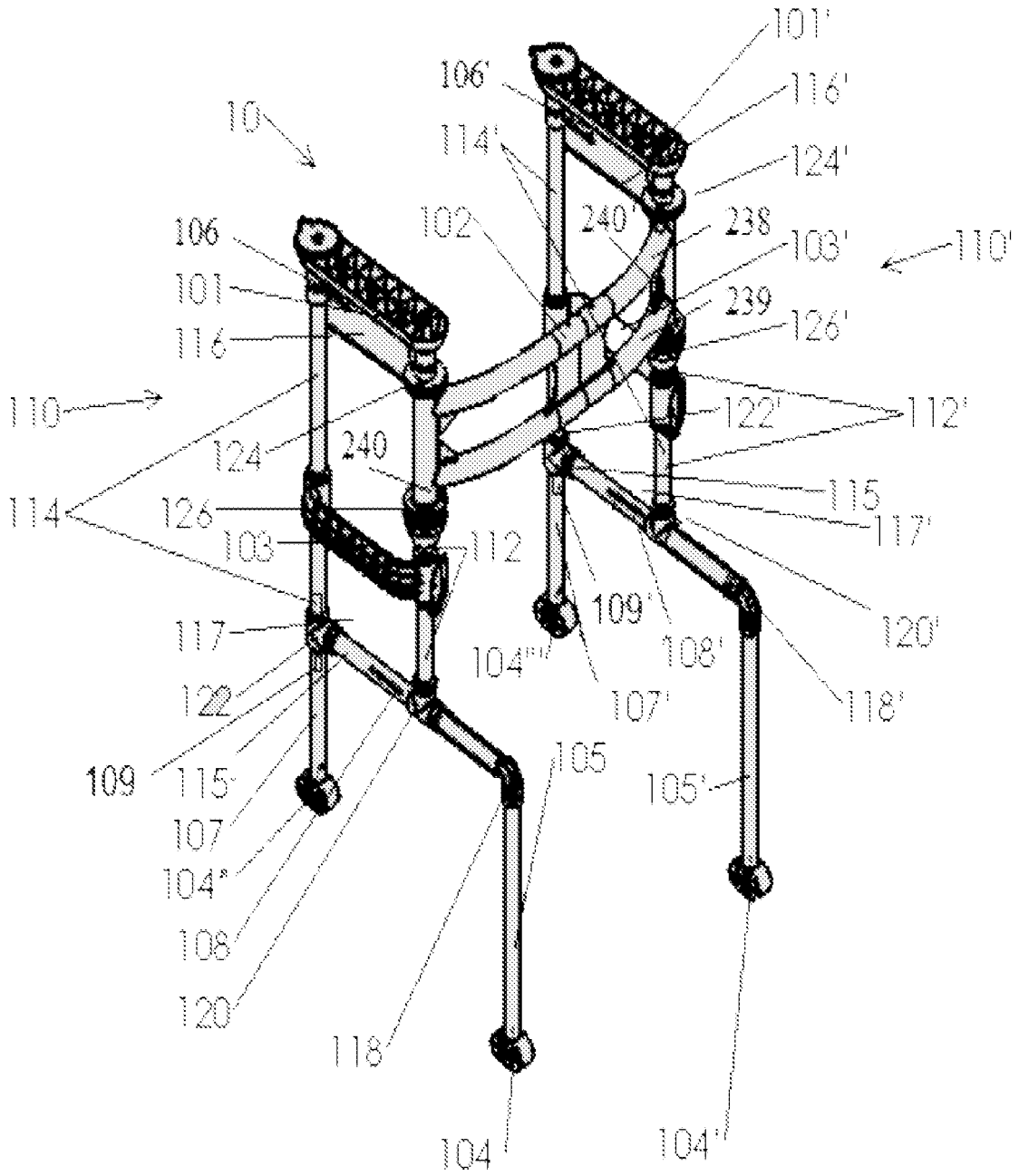
FIG. 1 is a schematic perspective view of a preferred embodiment of the invention.

Turning first to FIG. 1, a multiple terrain mobility device (herein, "Mobility Device") 10 is provided. The mobility device 10 provides the capability to transform and interchange between a Walker type device, and a pair of crutches, and additionally is capable, particularly in walker form, of traversing stairs and other types of difficult terrain. In FIG. 1, the mobility device 10 is shown in a basic walker configuration.

The mobility device 10 is comprised, generally, of a central cross support ("cross support") 102 and a pair of generally rectangular crutch assemblies 110, 110'. It is to be understood that reference or discussion of one crutch assembly 110 or its parts typically apply to the other respective crutch assembly 110' as well, except for components only requiring a single part, such as the extension controller 106.

Each of the respective crutch assemblies 110, 110' is comprised of at least one vertically oriented front support leg or support bar 112, 112' and at least one vertically oriented rear support leg 114, 114', each rear support leg or bar 114, 114' being rearward relative to the position of a user of the mobility device 10 facing forward. Each of the support bars 112, 114, 112', 114' can be, as in this embodiment, comprised of a single bar for greater strength, or can be a set of two bars fitted together at a junction at respective central crutch handles 103, 103. Each respective support bar 112, 114, 112', 114' can be a single or multi-piece construction, and in this embodiment, these are single pieces. In another embodiment, the support bars 112, 114, 112', 114' can, for example, be at least two pieces, each fitting into the central crutch handles 103, 103' for greater portability of the mobility device 10.

As is the case for all the components herein, the bars can be constructed of any is suitable material in the art, such as e.g., a lightweight metal, metal alloy, heavy duty metal, a plastic or other resin, fiberglass, wood, carbon fiber, or any combination thereof. For that matter, the entirety of the mobility device can be constructed of any such suitable material or combination of materials. The support bars 112, 114, 112', 114' can be of a solid or hollow construction. In this embodiment, the front and rear support legs 112, 114, 112', 114' are hollow and constructed of a lightweight metal such as stainless steel or aluminum, for a combination of strength and reduced weight.

The front and rear support legs 112, 114, 112', 114' are secured by, and help secure, several horizontally oriented components. At the top, there are respective top hand grips 101, 101' that extend from the front support legs 112, 112' to the rear support legs 114, 114' and can be secured to them by means known in the art. The top hand grips 101, 101' may have a non-smooth surface, such as with protrusions or cross hatching, to facilitate gripping, and prevent slippage, or be covered with padding for a more comfortable grip. The hand grips 101, 101' are capable of attachment to the support bars, 112, 114, 112', 114' by known means. This can be, for example, a cap and thread arrangement between the top hand grips 101, 101 or a set of hollow tubes of slightly larger diameter than the support bars, 112, 114, 112'. 114' and extending downward and capable of fitting over the support bars, 112, 114, 112', 114'. In this embodiment, the hand grips 101, 101' are each a single piece molded construction that fits over the respective sets of support bars 112, 114, 112'. 114'. As discussed previously, the hand grips, as is the case for other components, can be constructed of any suitable material as described herein and can be a single or multi-piece construction. In this embodiment, the hand grips 101, 101' are of a single piece plastic construction.

The mobility device 10 can further comprise an upper support 116, 116' located just below the hand grips 101, 101', and extending from the front to rear support legs 112, 114, 112', 114', to provide extra rigidity to the top area of each crutch assembly 110, 110'. The upper supports 116, 116' may be part of the hand grips 101, 101, made of any suitable material as discussed herein, and can be secured by any suitable means. The upper supports 116, 116' can be secured by a "slot and tongue" mechanism to the hand grips 101, 101, or can have rounded hollow walls at each end which can slip onto the support bars 112, 114, 112', 114' independently of the hand grips 101, 101. In this embodiment, the upper supports 116, 116' are part of a single piece plastic component with the hand grips 101, 101.

A pair of respective center crutch handles 103, 103' are also located between the respective sets of support bars 112, 114, 112', 114' and are connected to the front support legs 112, 112' in a relative position beneath the cross support 102.

The center crutch handles 103, 103' allow a user, as with typical crutch handles, to grip the crutches as the top hand grips 101, 101' rest in the user's armpits. In the walker position, the user is gripping the top hand grips 101, 101' while the center crutch handles 103, 103', at this point, simply provide extra structural support.

As with previous components, the crutch handles 103, 103' can be constructed of any suitable material or materials, constructed to provide a firmer, non-smooth surface grip, and secured to the support bar sets 112, 114, 112', 114' by any suitable means such as frictionally, or with protrusions and holes, or with at least one nut and bolt. In this embodiment, for example, the crutch handles are each a single piece construction with a hollow portion at each end capable of sliding over the support bars 112, 114, 112', 114'. The crutch handles 103, 103' are elevation adjustable to accommodate individual users. This adjustment can be achieved through any means known and commonly used in the art such as, e.g., a detent type system with apertures, or a an apparatus secured frictionally, or with a nut and bolt that is fitted through pre-set holes (not shown) in the support bars 112, 114, 112', 114' and center crutch handles 103, 103'.

Similar to the upper supports 116, 116', a set of lower supports 117, 117' can be placed at or near the bottom of the support bars 112, 114, 112', 114' to provide extra rigidity and support to the mobility device 10. The lower supports 117, 117' can be constructed of materials and secured to the support bars 112, 114, 112' 114' as discussed herein for other components. As will be seen, some components, such as the lower supports 117, 117' in this embodiment, can be constructed with apertures to reduce weight while still supplying structural support.

A basic rectangular structure is completed for each of the crutch assemblies 110, 110' by a respective lower or bottom support bar 115, 115' that connects the respective support bar sets 112, 114, 112' 114' to each other at the bottom of the structures.

The lower support bars 115, 115' are secured to the respective support bars 112, 114, 112' 114', with suitable fittings capable of securing the lower support bars 115, 115' to the respective support bars 112, 114, 112' 114', and respective extending or extendable lower legs 105, 105', 107, 107'. In this embodiment, the bottom end of the forward support bars 112, 112' are fitted into a front extension fitting 120, 120' that is generally T-shaped. The front leg fitting 120, 120' accommodates the front support legs 112, 112' and the lowersupport bars 115, 115'.

The lowersupport bars 115, 115' may be a single piece that fits within, and goes through, the front leg fitting 120, 120', as in this embodiment, or the lower support bar 115, 115' can be in two pieces, with one portion of the front leg fitting 120, 120' accommodating the portion of the lower support bar 115, 115' between the front leg fitting 120, 120' and rear leg fitting(s) 122, 122' and another portion accommodating the portion of the lower support bar 115, 115' between the front leg fitting 120, 120' and the front extension fitting 118, 118'. In another embodiment, the front leg configuration may substitute use of the extension fittings 118, 118' with a front leg 105, 105' that is a single 90 degree piece with one end extending from (and still retractable into) the lower support bar 115, 115' to the ground.

The front leg fitting 120, 120' is typically T-shaped and can accommodate the lower support bar 115, 115' and front support leg 112, 112'. The rear leg fitting 122, 122' is likewise typically T-shaped but with a different orientation, accommodating the rear support leg 114, 114', lower support bar 115, 115', and telescopic rear leg 107, 107'.

The rear leg 107 extends downward from the rear leg fitting(s) 122, 122' and is capable of being retracted or extended to adjust the height of the leg 107, 107'. The rear leg may be solid or as in this embodiment, of a telescoping construction. The rear leg can be raised and lowered through adjustment apparatus 109, 109'. The rear leg adjustment apparatus 109 can be of any type known in the art for extending or retracting a leg or pipe, such as, e.g., a motor or series of apertures with a detent type pin or depress-able button. The retraction or extension of the rear leg 107, depending upon the type of adjustment apparatus, may be initiated and controlled with an extension controller 106. The extension controller 106 is typically located at a convenient point of access to the user, such as, as in this embodiment, immediately below one of the hand grips 101, 101'.

Front legs 105, 105', like the rear legs 107, 107', extend downward and both sets of legs have feet 104, 104' 104", 104' at the bottom of the legs for gripping the ground without causing damage. The feet 104, 104' 104", 104'" can be comprised of any suitable material for this purpose, such as, e.g., a plastic or other resin, silicone, rubber, or rubberized material. The front legs 105, 105' are secured to the lower support bar 115, 115' with a 90-degree front extension fitting 118, 118' or the front legs 105, 105' can, as mentioned, be a single 90-degree piece.

The front of the lower support bar 115, 115', or (depending on the design of this part of the mobility device 10) the separate portion of the lower support bar 115, 115', between the front leg fitting 120, 120' and front extension fitting 118, 118', is extendable. The extension/retraction of the front legs 105, 105' can be accomplished via extension of the lower support bar 115, 115'. This portion of the lower support bar 115, 115' may be telescopic or of slightly smaller or larger diameter than the remainder of the lower support bar 115 so that it can collapse or retract within the remainder of the support bar 115, 115'. The front legs 105, 105' can, through this apparatus, be extended outward in a relatively forward direction to increase the stability of the mobility device 10. This can be particularly useful on uneven surfaces such as natural terrain or stairs. In this figure, the front legs 105, 105' are extended in a forward position to provide the extra stability to the walker.

Figure 1A:
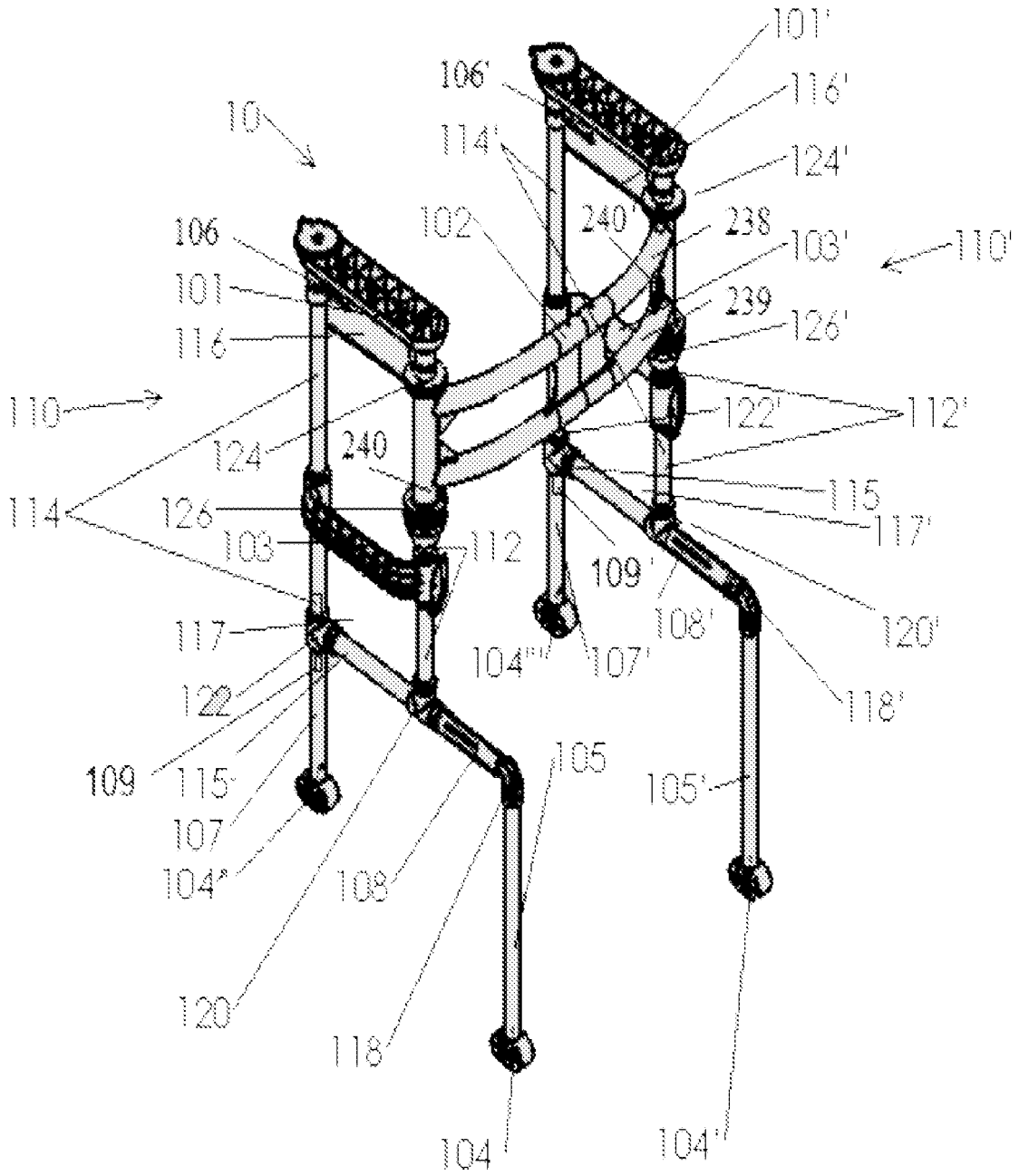
FIG. 1A is a schematic perspective view of a further embodiment of the invention.

Extension of the front legs 105, 105' can be accomplished with front leg extension apparatus 108, 108', located on the lower support bar 115, 115', or as shown in FIG. 1*a*, the front leg component, or on both. As with the case of the extension or retraction of the rear legs 107, 107, this extension apparatus 108 can be any suitable type known in the art, manual or automatically controlled including those already discussed, such as a detent type with apertures, or motor-controlled apparatus that can, likewise, be initiated and controlled with the extension controller lever.

Figure 2:
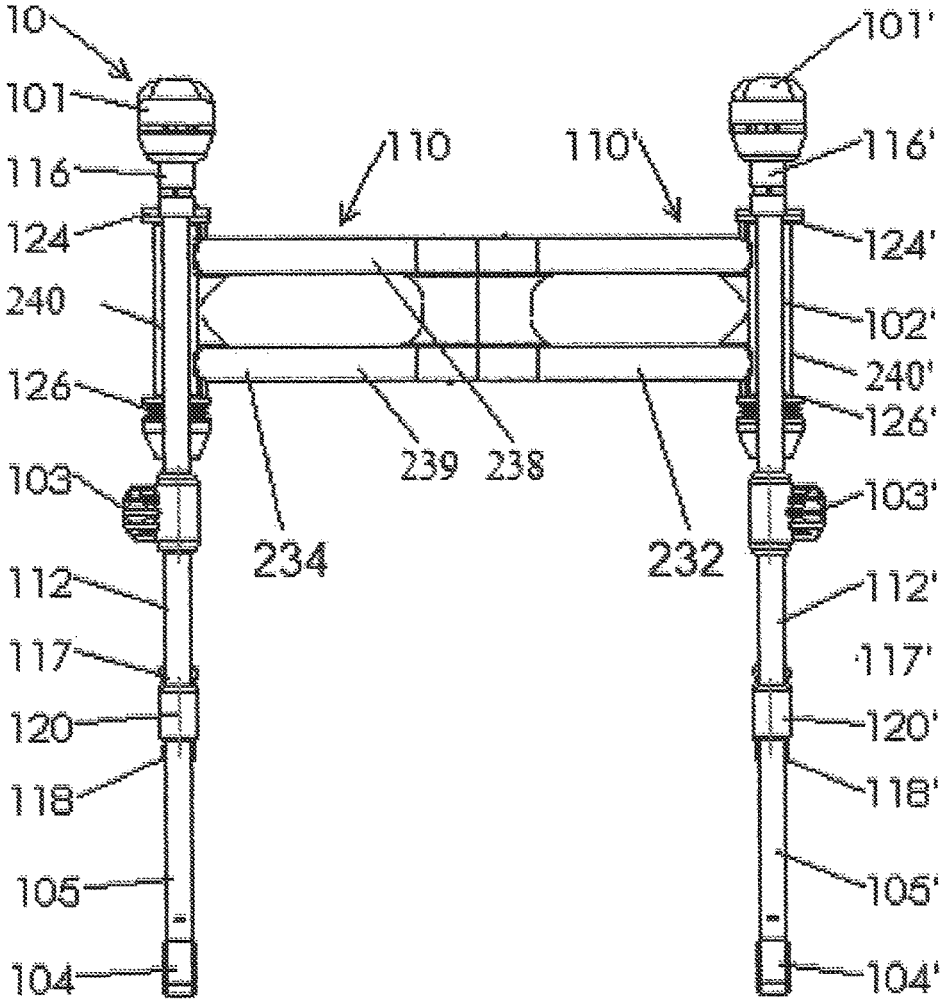
FIG. 2 is a schematic front view of the embodiment of FIG. 1 in a walker configuration.

Turning also to FIG. 2, but keeping FIG. 1 in mind, the crutch assembly portions 110, 110', are joined by a sturdy cross support 102 capable of securing both assemblies, yet allowing respective left and right cross support components 232, 234, to be swivel-able. The cross support structure 102 can, as in this embodiment, be generally curved to provide a concave space, thereby providing extra room for a user's hands to maneuver and use the crutch handles 103, 103' when in the crutch configuration. The respective crutch assembly portions 110, 110', are secured to the front support leg(s) 112, 112' by cross support moveable support apparatus 240, 240', which can be comprised of any means suitable in the art. This can be done e.g., with an arrangement of rings and securing bolts or, as in this embodiment cylinders, at the respective ends of the cross support 102, of slightly larger diameter than the front support legs 112, that are capable of fitting over the front support legs 112.

The cross support 102 is comprised of material and construction suitable to provide rigidity and support to the user and in this embodiment, is comprised of at least a pair of horizontal bars 238, 239 connected to the cross support moveable securing apparatus 240, 240'. The cross support 102 and its components can be constructed of suitable materials as described for other components.

The left and right cross support components 232, 234 can be constructed of suitable material or materials as discussed herein, and can be of a single piece or multiple piece construction. In this embodiment, each of the left and right cross support components 232, 234, except for the Joining/separation apparatus 236, is a single piece molded sturdy plastic construction.

The cross support is held in place by upper support bar fastener(s) 124, 124' and lower support bar fasteners 126, 126'. The upper support bar fasteners 124, 124" prevent the support bar from sliding upward along the support legs 112 and the lower support bar fasteners 126, 126' prevent the cross support 102 from sliding downward on the front support legs 102. The respective support bar fasteners 124, 124', 126, 126' fit around the front support bars 112, 112' and can be any suitable apparatus known in the art for this purpose.

Figure 3:
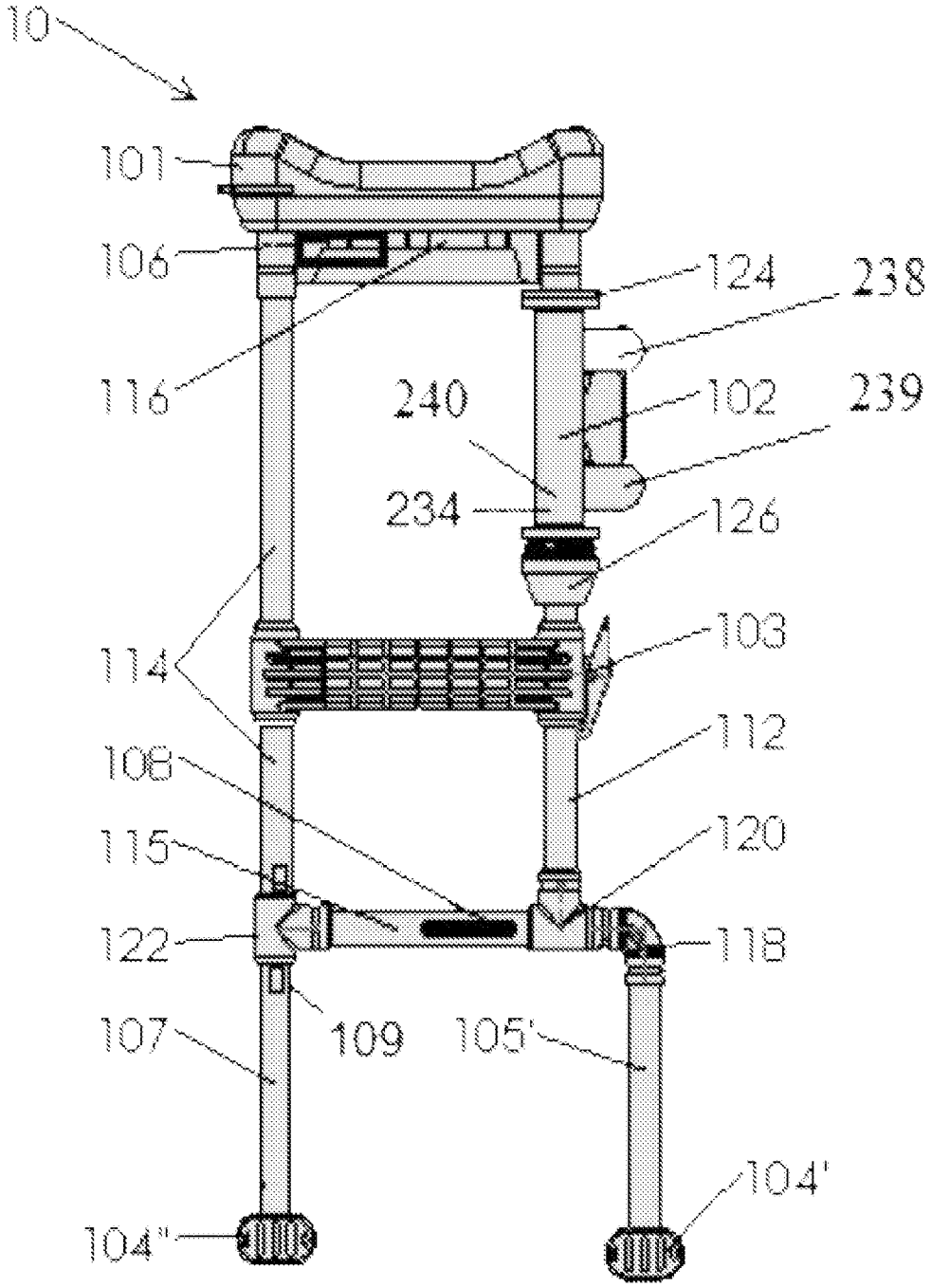
FIG. 3 is a schematic side view of the embodiment of FIG. 1 in a walker configuration showing the invention in use on a flat surface.
Figure 4:
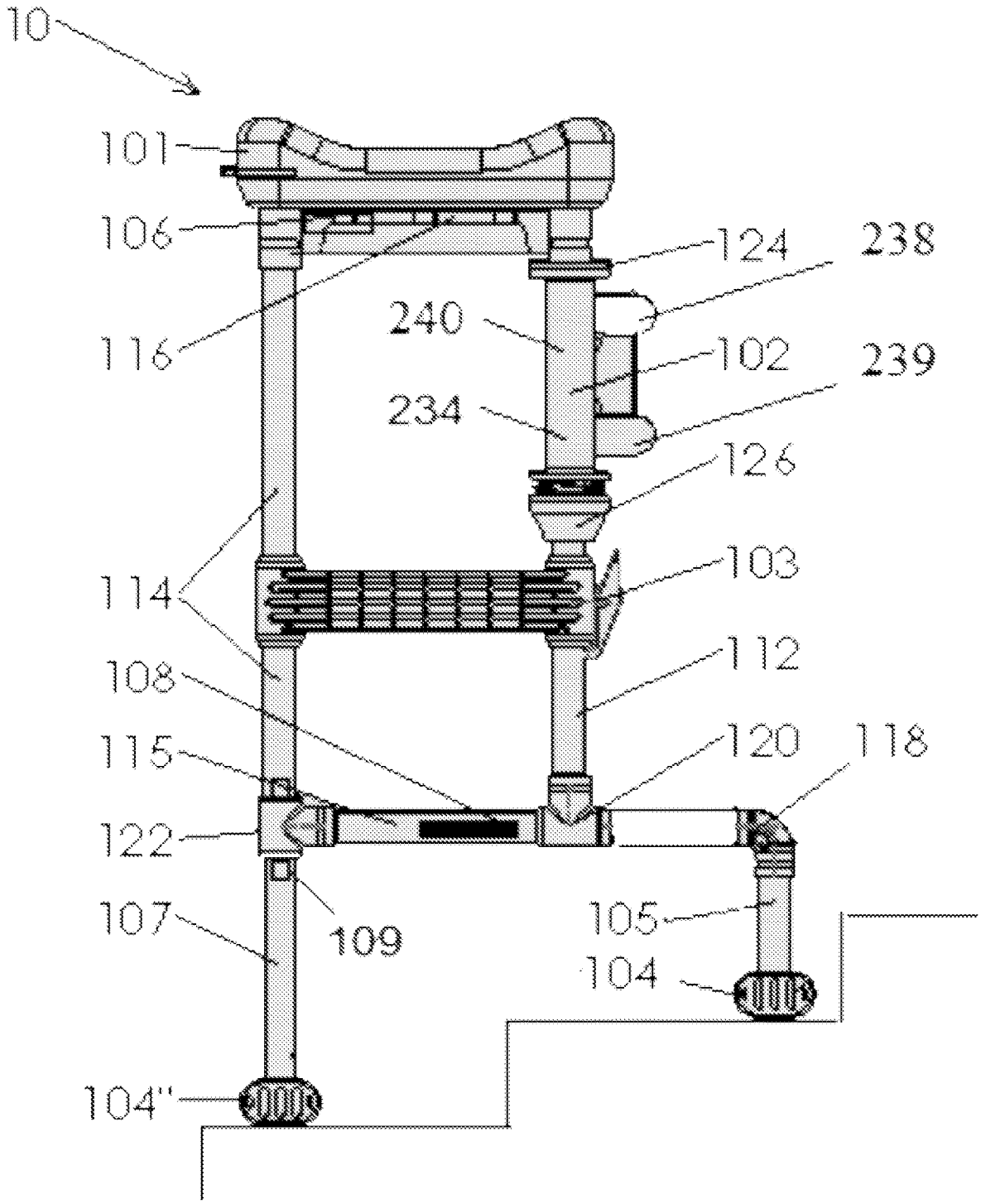
FIG. 4 is a schematic side view of the embodiment of FIG. 1 in a walker configuration showing the invention in use on an ascending surface.
Figure 5:
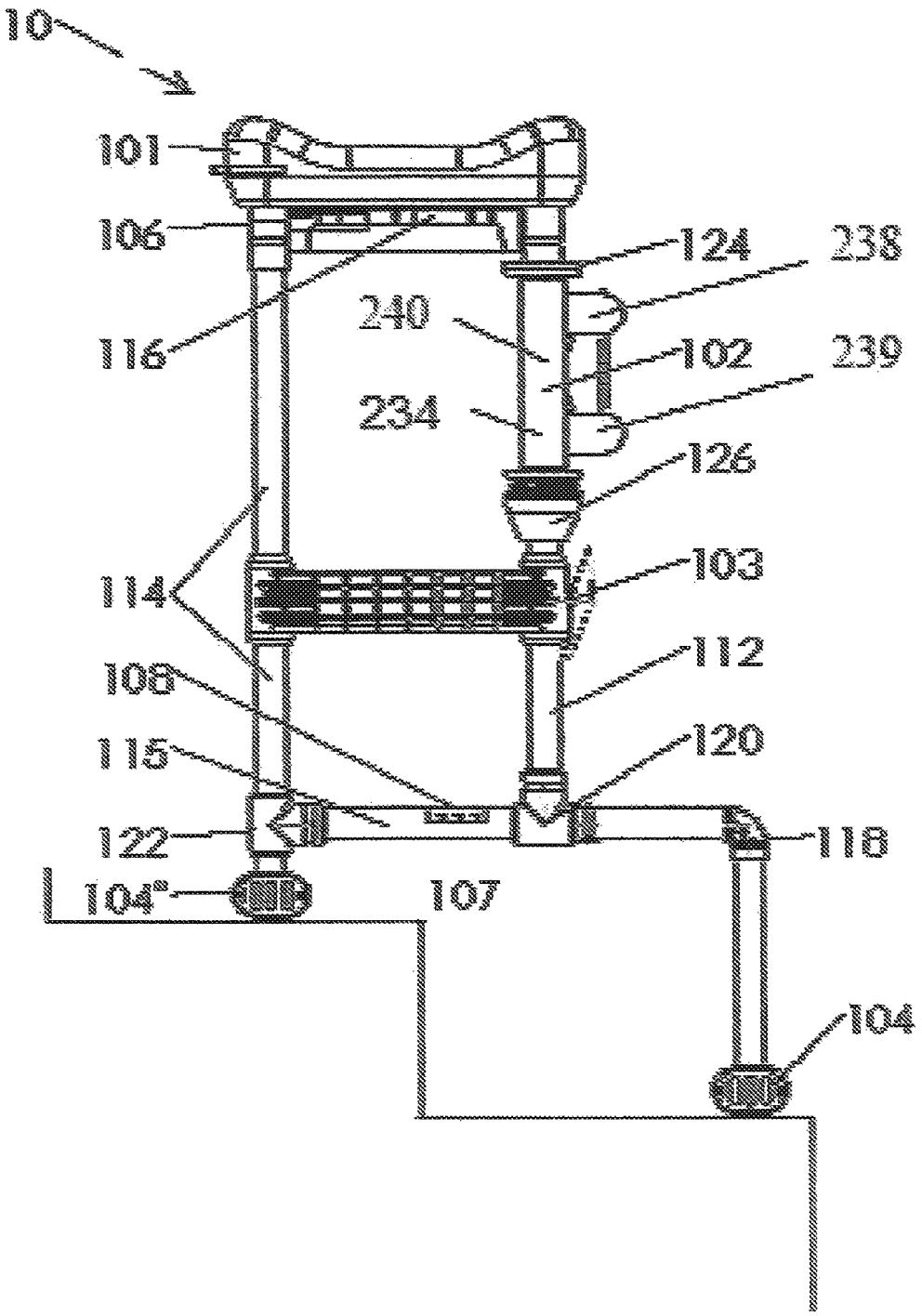
FIG. 5 is a schematic side view of the embodiment of FIG. 1 in a walker configuration showing the invention in use on a descending surface.

FIGS. 3-5 show the walker configuration of the device in use, effectively handling multiple terrain situations. Turning to FIGS. 3-5, but also referencing components visible in FIG. 1, a number of features will be shown.

Turning to FIG. 3, this figure shows the mobility device being used on a generally level surface. The rear leg 107 is in a mid-position of extension, with the bottom of the leg at roughly the same level of the bottom of the front leg 105. This figure depicts the front legs 105, 105' in a retracted position by use of the front leg extension/retraction apparatus 108, 108'. While adjustment apparatus can be provided to make the front legs 105, 105' upward and downward extendable, this embodiment features extension of the rear legs 107, 107' and forward extension of the front legs 105, 105, which are all that are needed to help a user conveniently traverse stairs and other terrain. The front legs 105, 105' do not have to be extended when the extra stability is not needed.

Turning to FIG. 4, if a user needs to move upward, for example, up a set of stairs, the lower legs can be adjusted accordingly. The rear legs 107, 107', can be extended further downward, to a point where the bottom of the leg is a suitable vertical distance below the bottom of the front leg 105 105'. This can be done, depending upon the type of adjustment apparatus 109, 109' used, manually or with the extension controller 106. With the level of the front leg 105, 105' set higher than the level of the rear leg 107, 107', the user can place the mobility device 10 against a set of stairs or other upwardly inclined terrain and move up the stairs. This figure depicts the front legs 105, 105' extended forward, by use of the front leg extension apparatus 108, 108'. This extension will provide additional stability to the mobility device 10 when it is in a walker configuration for additional stability.

As a specific example, the user can ascend a set of stairs by approaching the bottom of a staircase and placing the front legs 105, 105' and feet 104, 104' onto the top of the first step. The user can then actuate adjustment apparatus 109, 109' in the form of a quick release pin mechanism located inside the rear legs 107, 107' via the extension controller 106, which is in this embodiment is a lever button located under each of the respective top hand grips 101, 101'. This allows the rear legs 107, 107', which are telescopic in this embodiment, to extend telescopically and drop to the lower surface at the required height needed to have four solid points of contact with the stairs via the Feet 104, 104', 104", 104'". The user releases the extension controllers, here in the form of lever buttons 106, 106' located under each of the top hand grips 101, 101' to lock the rear legs 107, 107'. When the user reaches the top of the stairs and the telescopic rear legs 107, 107' contact the top of the final step, the user actuates the quick release pin mechanism adjustment apparatus 109, 109' again via the lever buttons 106, 106'. This retracts the telescopic rear legs 107, 107' to the same surface height as the front feet 105, 105' allowing the user to traverse flat surfaces again.

To further increase the adjustability of the mobility device 10, suitable apparatus for adjusting the height of the front leg 105, by extension or retraction, can also be added to the front leg 105. The front leg 105 can also be fixed, as in this embodiment.

Turning to FIG. 5, if a user needs to move downward, such as down a set of stairs, the rear leg 107 can be retracted such that the bottom of the front leg 105 is now vertically lower than the bottom of the rear legs 107, 107'. With the level changed, the user can now safely move downward. This figure shows the rear leg rear leg 107 fully retracted, up to eight inches, such that it is nearly flush with an upper stair. The mobility device 10 can be constructed such that the rear legs 107, 107' retract up to any useful length.

As in FIG. 1, the front legs 105, 105' are extended back into a forward relative position by activation of the front leg extension apparatus 108, 108' with accompanying extension of the bottom support bars 115, 115'. Moving down a set of stairs, for example, can be particularly dangerous and a situation that can call for the extra stability offered by extension of the front legs 105, 105'.

As a continuation of the specific example used in describing FIG. 4, the user can descend stairs by approaching the top of a staircase and placing the rear legs 107, 107', which are telescopic in this embodiment, onto the top of the first step. The user then actuates the adjustment apparatus 109, 109', herein again the quick release pin mechanism located inside the telescopic rear legs 107, 107', via the adjustment lever buttons 106, 106' located under each of the top hand grips 101, 101'. The rear legs 107, 107' are of slightly smaller diameter than the rear support legs 114, 114' such that they are capable of being retracted within the rear support legs 114, 114'.

The user can then slowly lower the mobility device 10 in a downward motion allowing the telescopic rear legs 107, 107' inner tubing to retract into the rear support leg 114, 114' outer tubing until the front feet 104, 104' make contact with the top of the lower coinciding step. The user then releases the actuator lever buttons 106, 106' located under each of the top hand grips 101, 101' to lock the telescopic rear legs 107, 107'. The mobility device 10 then has four solid points of contact with the stairs via the feet 104, 104', 104", 104'", which in this example are rubber or rubberized, and are attached onto the end of each of the front and rear legs 112, 112', 114, 114'. The mobility device 10 provides stability and support while the user is descending stairs or similar terrain.

When the user makes contact with the front feet 104, 104' at the bottom of the last step the user actuates the adjustment apparatus 109, 109' quick release pin mechanism again via the respective lever buttons 106, 106' located under each of the top hand grips 101, 101'. This allows the rear telescopic legs 107, 107' to extend and drop to the same surface height as the front feet 104, 104', allowing the user to traverse flat surfaces again.

Figure 6:
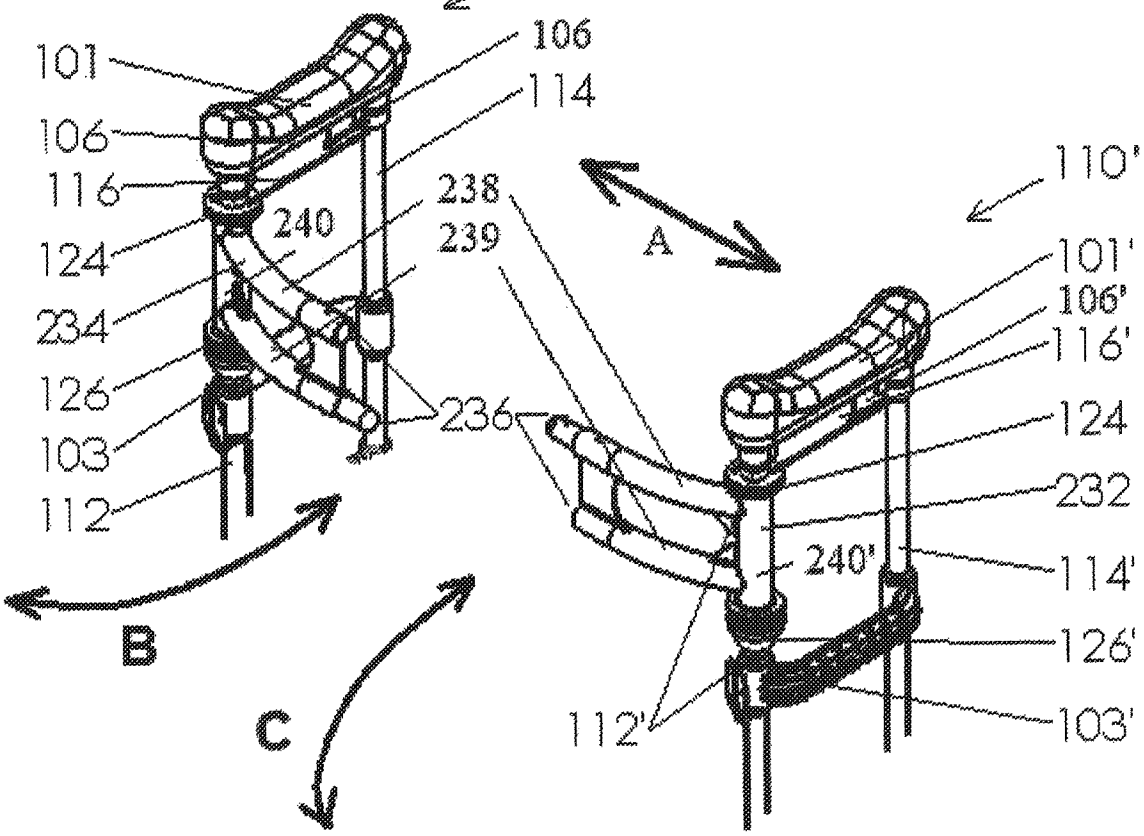
FIG. 6 is a schematic perspective view of a portion of the embodiment of FIG. 1 showing separation of the walker into a pair of crutches.
Figure 7:
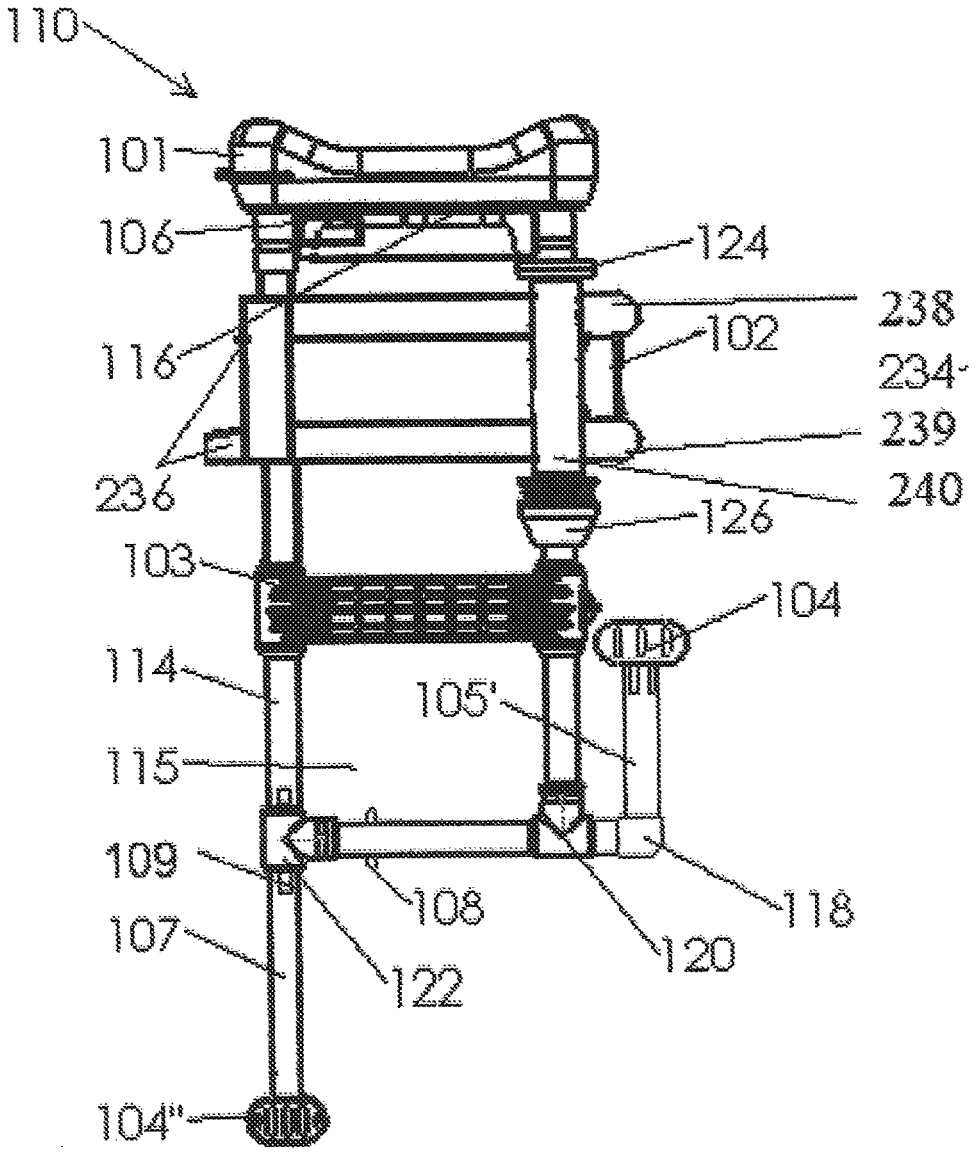
FIG. 7 is a schematic side view of the embodiment of FIG. 1 showing one of the crutches.
Figure 8:
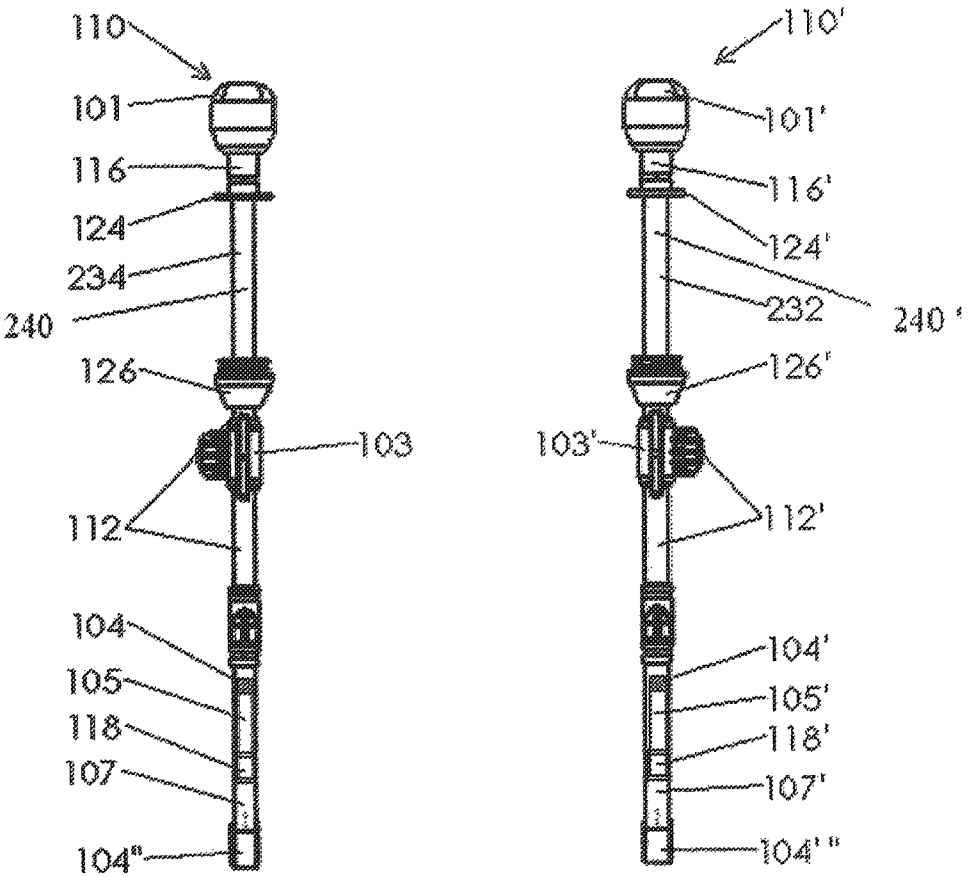
FIG. 8 is a schematic front view of the embodiment of FIG. 1 showing the invention configured as a pair of crutches.

FIGS. 6-8 show the mobility device 10 transformed into a pair of crutch assemblies 110, 110' and used as such. If a user wants to make greater speed across a surface, or is in a situation, such as at work, wherein it is preferable to be seen on crutches than with a walker, the user can quickly and easily transform the mobility device 10 from a walker configuration to a pair of crutch assembly configurations. If the terrain becomes less suited to crutches, the user can simply transform the crutch assemblies 110 back to a walker configuration.

Turning to FIG. 6, the cross support 102 is further comprised of a Left cross support piece 232 and a right cross support piece 234. A separation apparatus 236 is located at the junction between the left and right cross support pieces 232, 234 that holds the respective support pieces 232, 234 together. When a user wants to convert the mobility device 10 into crutches 110, 110', the user activates the separation apparatus 236, thereby separating the cross support pieces 232, 234, as illustrated by Arrow A.

The separation apparatus 236 can be of any suitable type in the art capable of effectively keeping the cross support 102 pieces joined, yet capable of easily separating them when desired by the user. A large number of suitable apparatus types for this purpose are known in the art. For example, the separation apparatus 236 can be a detent system with slide-able or depress-able buttons, a lever with actuator, or a threaded sleeve system. In this particular embodiment, a detent system is used with protrusions with spring actuated buttons capable of fitting into the cross support bars 238, 239 with apertures for the spring actuated button.

Once the cross support pieces 232, 234 are separated from each other, they can, depending upon the configuration of the mobility device 10, be swiveled with the Cross support moveable securing apparatus 240, 240' either 90 degrees inward or 270 degrees outward, to a position parallel to the hand grips 101, 101'. In this embodiment, the cross support pieces 232, 234 are turned 270 degrees outward, as shown by Arrows B and C, to the side of each crutch 110, 110'. Moving the cross support pieces 232, 234 outward, along with the outwardly curved shape of the cross support pieces 232, 234 in this embodiment, provide, as mentioned herein, a concave shape in the area of the crutch handles 103, 103, to improve usability and access. The cross support pieces 232, 234 can, if necessary, be secured to the sides by means known in the art.

Turning to FIG. 7, one of the crutches, the one forming the right side of the walker from a user's point of view, is shown. The front leg 105, of the crutch 110 can be swiveled 180 degrees to an upward orientation, and this is duplicated with the other crutch. At this point, and as further shown by FIG. 8, the mobility device has changed configuration to a pair of crutches 110, 110' and the user can use them accordingly.

Herein provided is a specific example of one embodiment of how a user could transform the mobility device 10 from a walker configuration into a pair of crutches by way of a quick release mechanism that the user actuates to separate the cross support 102.

Turning to both FIGS. 7-8, the user can unlock each individual piece 232, 234 of the cross support 102 by pressing downward against the spring tension and rotating each cross support bar 270 degrees towards the outside until it is under the top hand grip 110, 110 and it locks into position. The user then actuates the adjustment apparatus 109, 109', in this embodiment a quick release pin mechanism inside each of the rear legs 107, 107' via the respective Lever Buttons 106, 106' located under each of the top hand grips 101, 101'. This allows the rear legs 107, 107', which are telescopic and can be retracted within the rear support legs 114, 114', to extend and drop to the ground at the required height needed as a crutch for the user.

The user releases the lever buttons 106, 106' located under each of the top hand grips 101, 101' to lock the rear legs 107, 107'. The user then can adjust the respective center crutch handles 103, 103' on each crutch 110, 110' via a locking pin (not shown here) to the required height needed for the user. The top hand grips 101, 101' can then be used as under arm support pads in the crutch configuration. The user can also at their discretion invert the front feet 105, 105' 180 degrees on each crutch 110, 110' into an upward configuration. The user can also retract the front feet 105, 105' into the crutch via two manual detent pins or any other means suitable retraction means known in the art.

To convert the crutches back into a walker configuration, all the same steps are simply completed in reverse.

Accordingly, a multiple terrain mobility device and method of use is provided to users who may be recovering from an injury, recovering from post-surgery, suffering from long term ailments or any other medical condition that restricts mobility, which provides the capability to such users of moving across multiple types of terrain and traversing obstacles such as stairs using a single, portable device.

It is to be understood that while certain forms of the present invention have been illustrated and described herein, the expression of these individual embodiments is for illustrative purposes and should not be seen as a limitation upon the scope of the invention. It is to be further understood that the invention is not to be limited to the specific forms or arrangements of parts described and shown.

The invention claimed is:

1. A multiple terrain mobility device comprised of a central cross support and a pair of crutch assemblies,
- wherein each respective crutch assembly is comprised of a set of support legs which include at least one vertically oriented front support leg and at least one vertically oriented rear support leg and at least a pair of horizontally oriented components,
- wherein each respective rear support leg is rearward of the respective front support leg relative to the position of a user of the mobility device facing forward,
- wherein the respective front and rear support legs are secured by, and help secure, the at least a pair of horizontally oriented components,
- wherein the at least a pair of horizontally oriented components are comprised of a top hand grip that extends from the front support leg to the rear support leg,
- at least one center crutch handle, also extending from the front support leg to the rear support leg, and is connected to the front and rear support legs in a relative position beneath the top hand grip,
  - and at least one bottom support bar also extending from the front to the rear support leg in a relative position beneath the at least one center crutch handle,
- and wherein the rear support leg further comprises adjustment apparatus capable of extending the rear leg downward or retracting the rear leg upward to adjust a height of the rear leg, and
- further comprised of an extendable or retractable front leg component connected to the at least one bottom support bar in a relative forward direction from the front support leg, and
- and further comprised of a front leg adjustment apparatus for retracting the front leg component or extending the front leg component in horizontal or vertical directions to provide extra horizontal and vertical stability and
- wherein the central cross support is further comprised of a left cross support member and a right cross support member relative to a user,
- and a separation apparatus that is capable of both securely holding the left and right support members together and reversibly separating them, located in proximity to an area between the left and right cross support members,
- and wherein the rear leg adjustment apparatus is comprised of either a motor with a controlling device or a detent adjustment apparatus,
- and is further comprised of an extension controller capable of retracting or extending the rear leg.

2. The multiple terrain mobility device according to claim 1, wherein the cross support members are each comprised of at least a pair of horizontal bars connected to moveable cross support securing apparatus,
- and wherein the moveable cross support securing apparatus is capable of securing the respective left and right cross support members to the respective front support legs such that the left and right support cross support members are capable of rotating up to 270 degrees.

3. The multiple terrain mobility device according to claim 1, wherein the left and right cross support members, the front support legs, rear support legs, the top hand grips, the center crutch handles, the lower support bars, front leg components, and general crutch assemblies are each of a single or multiple-piece construction, and are each constructed of a metal, plastic or other resin, wood, fiberglass, carbon fiber, or a combination thereof.

4. The multiple terrain mobility device according to claim 1, wherein either:
- the front leg component is a retractable 90-degree component, directly or indirectly connected or fitted to the bottom support bar, or
- the front leg component is a vertical component connected directly or indirectly to the bottom support bar at a 90-degree angle, and wherein the bottom support bar is retractable or extendable and is capable of being extended further forward than the front support leg.

5. The multiple terrain mobility device according to claim 1, wherein the top hand grips have a non-smooth surface to facilitate gripping, are covered with padding for a more comfortable grip, or a combination thereof.

6. The multiple terrain mobility device according to claim 1, wherein each crutch assembly is further comprised of an upper support located just below the top hand grip and secured to the front and rear support leg, and wherein the upper support is either part of a single piece construction with the top hand grip or a separate component.

7. The multiple terrain mobility device according to claim 1, wherein the respective crutch handles are height adjustable, and
- wherein the height adjustability of the respective crutch handles is brought about by a detent type system with apertures located in proximity to the respective crutch handles, a frictionally securing apparatus within or in proximity to the respective crutch handles, or at least one bolt and nut fitted through at least one of a plurality of apertures in the support bars and center crutch handles.

8. The multiple terrain mobility device according to claim 1, wherein the bottom support bars are secured to the respective front and rear support legs with respective front and rear support leg fittings capable of securing the bottom support bars to the respective front and rear support legs.

9. The multiple terrain mobility device according to claim 1, wherein the bottom support bar goes through, and is extendable beyond, a front leg fitting and is attached to the front leg component at a 90-degree angle, or the bottom support bar is secured between the front leg fitting and a rear leg fitting and the front leg component is a single or multiple piece 90-degree component with one end extending from, and retractable into, the bottom support bar.

10. The multiple terrain mobility device according to claim 1, wherein the rear support legs are of a telescopic construction.

11. The multiple terrain mobility device according to claim 1, wherein the front leg component is capable of being rotated at least 180 degrees from a downward to an upward orientation.

12. The multiple terrain mobility device according to claim 1, wherein the front leg components and rear support legs are each further comprised of feet at the bottom of the legs for gripping the ground, and wherein the feet can be comprised of a plastic or other resin, silicone, rubber, or rubberized material.

13. The multiple terrain mobility device according to claim 1, wherein the bottom support bar extends beyond the front support leg and a portion of the bottom support bar is telescopic or of slightly smaller or larger diameter than the remainder of the bottom support bar such that it is capable of retracting within the remainder of the support bar.

14. The multiple terrain mobility device according to claim 1, further comprising a front leg extension apparatus located on the bottom support bar, on the front leg component, or a combination thereof, and wherein the front leg extension apparatus is capable of being extended forward or retracted rearward, and wherein the leg extension apparatus is manually or automatically controlled.

15. The multiple terrain mobility device according to claim 14, wherein the front leg extension apparatus is a detent type apparatus with apertures and a detent type pin or button, or is a motor-controlled apparatus.

16. The multiple terrain mobility device according to claim 1, wherein the cross support is generally curved to provide a concave space, when the left and right cross support members are connected together.

17. The multiple terrain mobility device according to claim 1, wherein the separation apparatus of the central cross support is comprised of a detent system with slide-able or depress-able buttons, a lever with actuator, or a threaded sleeve system.

18. The multiple terrain mobility device according to claim 1, wherein the left and right cross support members of the central cross support are capable of being swiveled either 90 degrees inward or 270 degrees outward to a position parallel to the hand grips.

* * * * *